United States Patent [19]

Miller

[11] 4,431,223

[45] Feb. 14, 1984

[54] ENGINE LIFT TOOL

[75] Inventor: Harold R. Miller, Hazel Green, Wis.

[73] Assignee: Deere & Company, Moline, Ill.

[21] Appl. No.: 394,228

[22] Filed: Jul. 1, 1982

[51] Int. Cl.[3] ..... B66C 1/66

[52] U.S. Cl. ..... 294/67 AA; 294/78 A

[58] Field of Search ..... 294/67 AA, 81 SF, 67 DA, 294/81 R, 82 AH, 78 R, 78 A, 67 R; 414/137, 139, 626

[56] References Cited

U.S. PATENT DOCUMENTS

| | | | |
|---|---|---|---|
| 2,412,488 | 12/1946 | Austin | 294/78 A |
| 3,751,097 | 8/1973 | Jones et al. | 294/67 AA |
| 3,995,903 | 12/1976 | Ernst | 294/81 |

*Primary Examiner*—James B. Marbert

[57] ABSTRACT

An engine lift tool includes bracketry adapted for connection to fore-and-aft spaced locations of an engine. A hanger is releasably secured to the bracketry and includes a lift bail pivotally connected to a screw-operated slide member such that operation of the slide member will result in the lift point being shifted to effect a desired attitude in an engine supported by the lift tool.

5 Claims, 5 Drawing Figures

ENGINE LIFT TOOL

BACKGROUND OF THE INVENTION

The present invention relates to engine lift tools and more particularly relates to hangers including lift bail or ring connections which provide fore-and-aft adjustment for locating the lift points at various desired locations relative to the center of gravity of an engine being lifted.

U.S. Pat. No. 3,995,903 granted to Ernst on Dec. 7, 1976 discloses an engine lift tool including a hander in the form of a yoke having a lift ring received thereon and movable into selected notches provided in a lower edge thereof so as to alter the lift point relative to the center of gravity of an engine being lifted. While this patented arrangement provides a simple structure for effectively adjusting the lift point, it requires that the weight of the engine be removed from the hanger before the adjustment can be made. Often times a convenient support surface is not available in which case additional equipment such as lift tables or hoist-operated slings may be required to change the attitude of the engine sufficiently to avoid obstructions afforded by the vehicle into or from which the engine is being installed or removed. Such extra equipment of course requires extra manpower to operate. Sometimes a worker will try to "manhandle" the engine in which cases he may injure his back or he may place his hands in areas where they are apt to be injured due to being caught between the engine and adjacent structure. Even when a convenient surface is available for resting the engine while the lift point is adjusted, this adjustment procedure can be quite time consuming especially if several adjustments are required.

SUMMARY OF THE INVENTION

According to the present invention there is provided an improved engine lift tool and more specifically there is provided an improved hanger having an adjustable lift point.

A principal object of the invention is to provide an engine lift tool including a hanger having a lift point which may be adjustable while an engine is suspended from the tool.

Another object of the invention is to provide an engine lift tool including a hanger having a lift point which is power shiftable among various desired locations whereby a single operator can safely control the attitude of an engine being manipulated into or from its installed position in a vehicle frame.

A further object of the invention is to provide a hanger, as set forth in the previous objects, which is adapted for connection to various engine connection brackets whereby one hanger may be used as a part of different engine lift tools for lifting different engines.

The foregoing and other objects of the invention are achieved by a structure including a hanger including a lift bail pivotally mounted on a slide member to define a lift point. The slide member is received on a guide shaft which extends crosswise to the bail pivot, and an Acme screw shaft is arranged in parallel relationship to the guide shaft and received in a nut fixed to the guide member whereby rotation of the screw will shift the guide member and, hence, the lift point along the guide shaft. The hanger is releasably connected to bracketry adapted for connection to an engine through means of a forwardly facing notch of the hanger in which is received a cross member of the bracketry and a pin which extends through axially aligned mounting openings afforded by the hanger and the bracketry.

The nature of the invention and its several features and objects will be more readily apparent from a reading of the ensuing description together with the appended drawings.

DESCRIPTION OF THE PREFERRED EMBODIMENT

Figure 1:
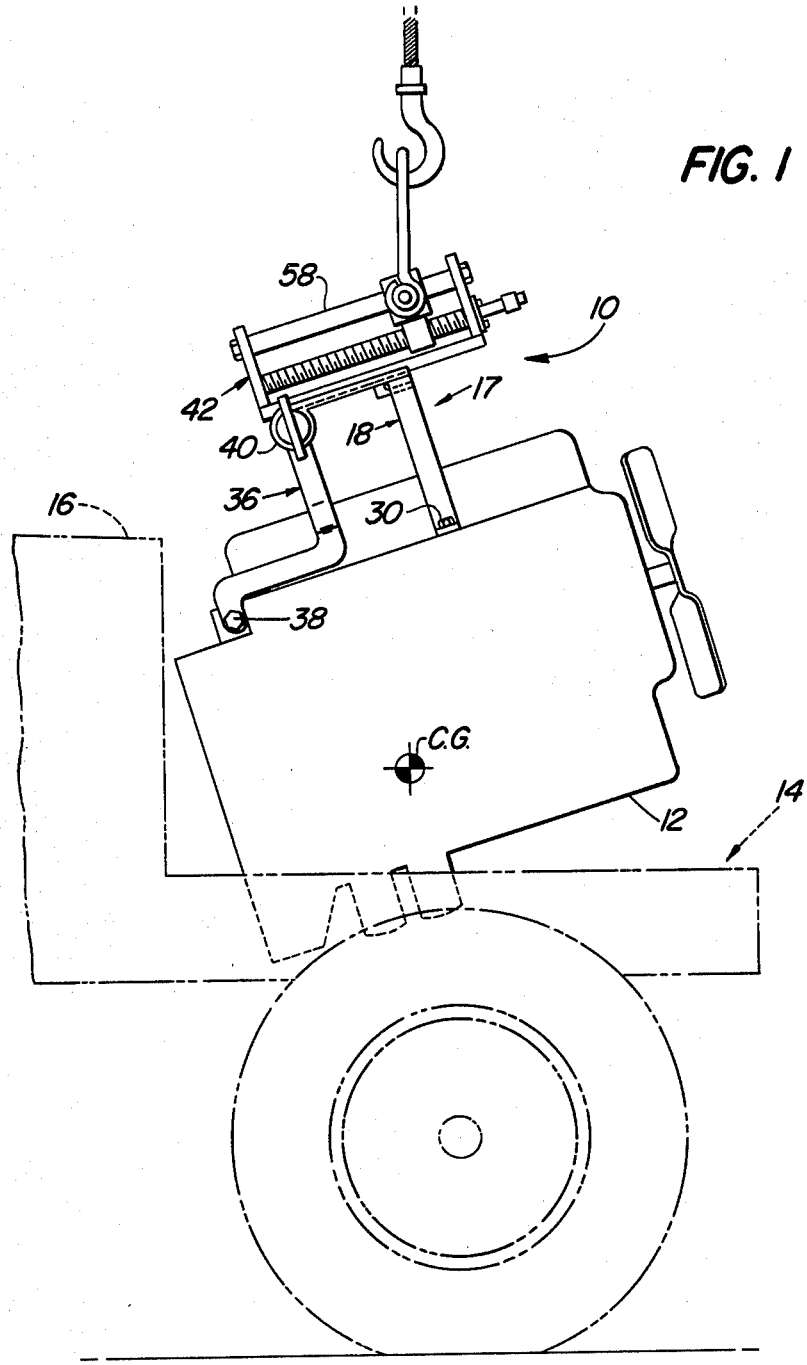
FIG. 1 is a somewhat schematic right side view showing an engine being installed into a frame of a lower vehicle by means including an engine lift tool constructed in accordance with the principles of the present invention.

Referring now to FIG. 1, therein is shown an engine lift tool 10 connected to and shown in the process of installing an engine 12 into a loader vehicle frame 14, a portion of which is shown in outline. In a manner to be fully described below, the lift tool 10 is operable for tilting or changing the attitude of the engine 12 to aid in its installation or removal. For example, in FIG. 1 the engine 12 is shown tilted for clearing an obstruction afforded by an inverted, U-shaped loader support tower 16 that forms an integral part of the frame 14.

Figure 3:
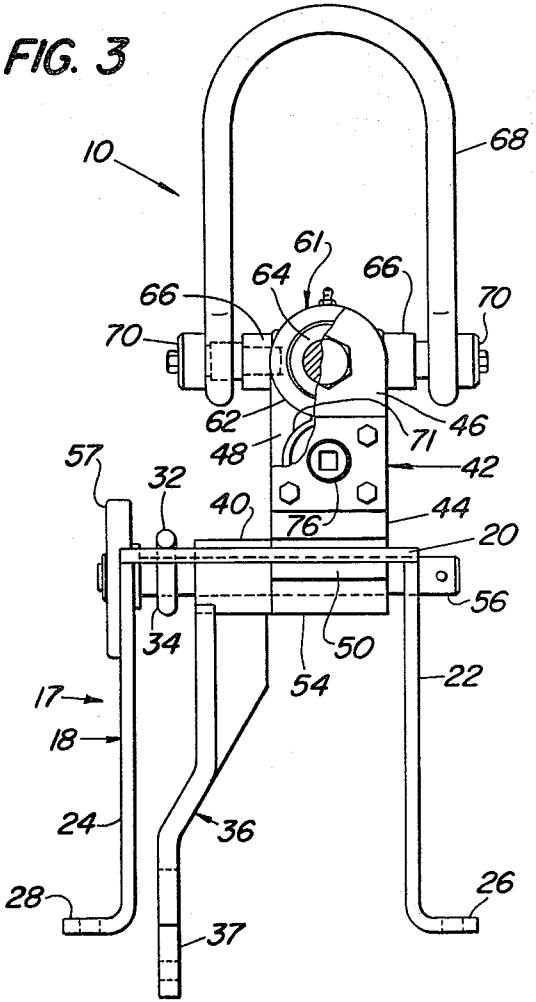
FIG. 3 is a right end view of the tool shown in FIG. 2.
Figure 2:
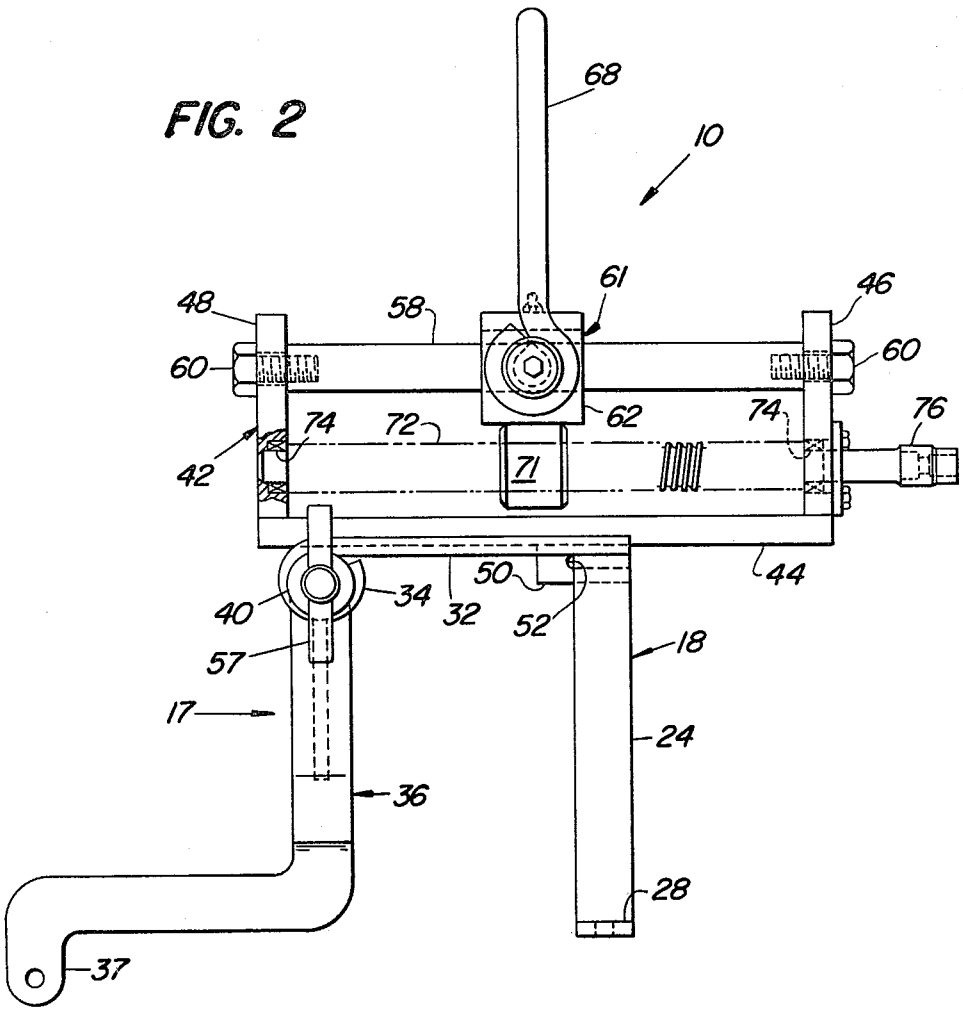
FIG. 2 is a side elevational view of the engine lift tool.

Referring now also to FIGS. 2 and 3, it can be seen that the engine lift tool 10 includes an engine connecting bracket 17 formed in part by an inverted U-shaped strap 18 having a transverse bight portion 20 joining transversely spaced vertical leg portions 22 and 24 having oppositely turned lower ends respectively defining tabs 26 and 28 which are provided with holes in which bolts 30 are received so as to fix the strap 18 to the engine 12. Having a purpose set forth below, a fore-and-aft extending rod 32 has a forward end welded to the top of the bight portion 20 at a location adjacent the left-hand end of the latter, as viewed in FIG. 3. The rearward end of the rod 32 is bent to form an eyelet 34 defining a transverse opening. The engine connecting bracket 17 also includes a reverse L-shaped strap 36 having a downturned tab 37 formed at the rearward end of the horizontal leg thereof and provided with a transverse hole in which a bolt 38 is received so as to connect the bracket 36 to the engine 12. The upper end of the vertical leg of the strap 36 is formed by a cylindrical tube 40 arranged to provide a transverse mounting hole.

The lift tool 10 further includes a hanger 42 which is releasably secured to the bracket 17. Specifically, the hanger 42 comprises an elongate, support or base member 44 formed by a flat bar to the opposite ends of which are respectively fixed upwardly projecting front and rear end members or lugs 46 and 48. Fixed to the underside of the base member 44 is a mounting bar 50 having a forwardly opening notch or receptacle 52 formed therein. The bight portion 20 of the strap 18 is received in the notch 52. Fixed to the underside of the base member 44 at a location adjacent the rear end of the latter is a cylindrical tube 54 which is arranged to define a transverse opening. The openings defined by the eyelet 34, the cylindrical tube 40 and the cylindrical tube 54 are in axial alignment with each other, with the tube 40 being between the eyelet 34 and the tube 54. A connection pin 56 is received in the openings, and thus cooperates with the notched mounting bar 50 in securing the engine connecting bracket 17 to the hanger 42. The pin 56 has a hand grip 57 fixed to its left-hand end (FIG. 3) for aiding in its insertion and removal from the mounting openings provided.

The hanger 42 further comprises a guide shaft or rod 58 received between the end members 46 and 48 held in place by cap screws 60 which extend through openings provided in the end members and are received in threaded openings provided in opposite ends of the shaft. A slide member 61 is composed of a welded assembly including a collar 62 having a bushing 64 pressed therein and slidably mounted on the shaft 58. A threaded hole is provided through the collar on an axis which intersects and is perpendicular to the shaft 58. Welded to the opposite sides of the collar in axial alignment with the threaded hole are a pair of threaded spacers 66. An inverted U-shaped lifting bail 68 is formed from a rod having eyelets formed at the lower ends of the legs of the bail. The bail is connected to the collar by means of a pair of shoulder bolts 70 received in a respective lifting bail eyelet and threaded into a respective spacer and the collar to thus establish a lift point in the form of a horizontal transverse pivot axis between the bail and the collar. Welded to the bottom of the collar 62 is a special cylindrical nut 71 which is received on an Acme screw shaft 72 which is mounted for rotation in the end members 46 and 48 by bearings 74. The forward end of the screw shaft 72 has a non-threaded portion extending beyond the end member 46 and provided with a socket 76 adapted for receiving the drive shaft of a hand or power tool.

Thus, it will be appreciated, that once the lift tool 10 has been secured to an engine and the engine has been lifted from its support by means of some sort of hoist connected to the bail 68, the engine will seek a certain attitude depending upon the location of its center of gravity relative to the transverse pivot axis or lift point defined by the connection of the legs of the bail 68 to the slide member 61 and that this attitude may be changed by operating the screw shaft 72 so as to change the location of the pivot axis. For example, assuming that the engine being lifted has assumed the position of the engine 12, shown in FIG. 1, then the engine may be caused to assume a more level attitude by operating the shaft 72 so as to cause the slide member 61 to move rearwardly, the level position occurring when a vertical transverse plane passing through the center of gravity of the engine makes a right angle with the guide shaft 58.

The hanger 42 may be releasably connected to engine connecting brackets which are designed for use with engines different than the engine 12 with which the bracket 17 is adapted for use. It will be appreciated that to adapt a bracket for use with the hanger 42 it is necessary only that connection members be provided for reception in the notch 52 and for receiving the connection pin 56.

Figure 5:
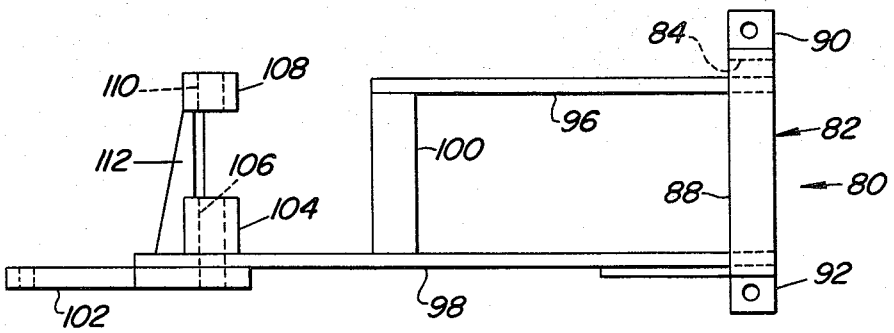
FIG. 5 is a top plan view of the bracketry illustrated in FIG. 4.
Figure 4:
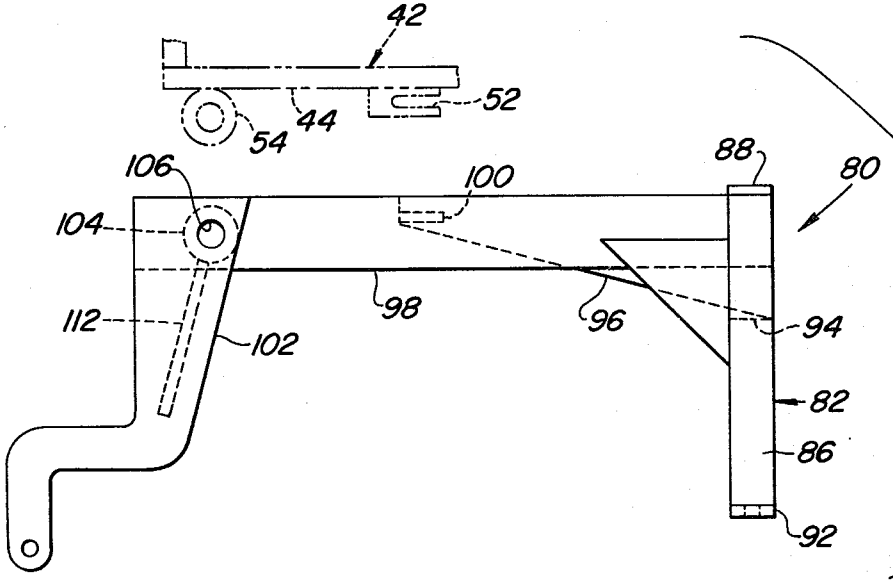
FIG. 4 is a side elevational view of alternate engine connecting bracketry for adapting the lift tool for lifting an engine of a size different than that adapted to be lifted by the bracketry illustrated in FIGS. 1–3 and showing a portion of the hanger in phantom.

One example of an alternate form of engine connecting bracket with which the hanger 42 is usable is illustrated in FIGS. 4 and 5. Specifically, therein is shown a one-piece engine connecting bracket 80 including an inverted U-shaped assembly 82 comprising opposite legs 84 and 86 respectively joined at their tops by a bight portion 88 and provided with oppositely projecting tabs 90 and 92 which have holes therein for receiving bolts for securing one end of the bracket to an engine. A spacer bar 94 is welded to the underside of the bight portion 88 and to the leg 84, and a fore-and-aft extending, vertically disposed, trapezoidal, plate 96 is welded against the spacer and to the bight portion. The plate 96 has a horizontal upper edge and a lower edge which converges rearwardly toward the upper edge. Welded to the underside of the bight portion 88 and to the leg 86 is a fore-and-aft extending relatively narrow rectangular plate 98 which extends rearwardly beyond and in parallel relationship to the plate 96. A horizontally disposed strap 100 is fixed between the rear end of the plate 96 and an intermediate location of the plate 98, the strap 100 being adapted for reception in the notch 52 of the hanger 42. Welded to the rear end of the plate 98, on the opposite side thereof from the strap 100, is a downwardly and forwardly extending dog-leg shaped plate 102 having a downturned rearward end provided with an opening for receiving a bolt for securing the rear end of the bracket 80 to an engine. Welded to the rear end of the plate 98 on the side opposite from the plate 102 is a first boss 104 having a transverse mounting hole 106 provided therein in alignment with a hole provided in overlapping portions of the plates 98 and 102. A second boss 108 contains a transverse mounting hole 110 and is supported in transversely spaced relationship to the boss 104 by a gusset 112 having an end welded to the plate 102 and an edge welded to the boss 104. The mounting holes 106 and 110 provided by the bosses 104 and 108 are axially aligned with each other and are adapted for alignment with the mounting hole provided by the tube 54 of the hanger 42 for receiving the pin 56 for completing the attachment of the bracket 80 to the hanger 42 once the strap 100 is received in the notch 52.

It will be appreciated that once the hanger 42 is connected to the bracket 80 and the latter is connected to an engine, the screw shaft 72 will be operative to change the fore-and-aft location of the slide member 61 relative to the attachment points afforded by the plate 102 and the legs 84 and 86 and hence will be operative to change the attitude of the engine.

I claim:

1. In an engine lift tool including a hangar defining an elongate guide surface, a slide member mounted for movement along said guide surface and a screw shaft coupled to the slide member for selectively adjusting its position along the guide surface, the improvement comprising: said hangar including a base member underlying said guide surface; a tube fixed to and extending crosswise to the base member and defining a transverse opening; a mounting bar fixed to the base member in parallel relationship to the tube and defining a receptacle opening in a direction away from said tube; a bracket having a plurality of spaced legs and having a cross member releasably received in said receptacle and having an opening aligned with said tube; and a pin releasably received in said opening and tube.

2. The engine lift tool defined in claim 1 wherein said bracket is constructed of one piece and wherein said opening is defined by first and second tube sections located at opposite ends of the tube connected to the base member.

3. The engine lift tool defined in claim 1 wherein the bracket is constructed of first and second pieces with the first piece containing said cross member and with the second piece containing said opening.

4. The engine lift tool defined in claim 3 wherein said first piece includes a connection member which has one end fixed to the cross member and has a second end defining a portion of the opening in which said pin is received.

5. The engine lift tool defined in claim 4 wherein said connection member is a rod having an eyelet at one end defining said portion of the opening.

* * * * *